US005534836A

United States Patent [19]

Schenkel et al.

[11] Patent Number: 5,534,836

[45] Date of Patent: Jul. 9, 1996

[54] DEACTIVATOR FOR THEFT-DETERRENT MARKERS

[75] Inventors: Howard M. Schenkel, Boca Raton; Jon Buzzard, Margate; Jeffrey J. Ronan, Deerfield Beach, all of Fla.

[73] Assignee: Sensormatic Electronics Corporation, Deerfield Beach, Fla.

[21] Appl. No.: 345,479

[22] Filed: Nov. 28, 1994

[51] Int. Cl.[6] ..... H01F 13/00

[52] U.S. Cl. ..... 335/284; 340/551; 340/572

[58] Field of Search ..... 335/284; 340/572, 340/551

[56] References Cited

U.S. PATENT DOCUMENTS

| | | | |
|---|---|---|---|
| 4,499,444 | 2/1985 | Heltemes et al. | 335/284 |
| 4,665,387 | 5/1987 | Cooper et al. | 340/572 |
| 5,288,980 | 2/1994 | Patel et al. | 235/381 |

OTHER PUBLICATIONS

Brochure dated Aug. 1993 describing the "Speed Station" deactivation station sold by Sensormatic Electronics Corp.

*Primary Examiner*—Brian W. Brown
*Assistant Examiner*—Raymond M. Barrera
*Attorney, Agent, or Firm*—Robin, Blecker, Daley & Driscoll

[57] ABSTRACT

A deactivator for use in an electronic article surveillance system has a housing having a first receptacle containing a deactivator for deactivating a theft-deterrent marker carried on an object such as a compact disk case, an audio cassette case or a video cassette case. The first receptacle is made up of a base, a first wall and a second wall, the walls being spaced apart such that an object carrying the theft-deterrent marker can be placed between the walls. The first wall is slidable relative to the second wall. The housing also has a second receptacle with a deactivator for deactivating a theft-deterrent marker carried on a generally rectangular object such as an audio cassette box having a top and a bottom, first and second sides and first and second ends, the marker being carried by one of the sides or one of the ends. The device comprises a housing having a receptacle comprising first, second and third walls arranged so as to form three sides of a box. A plurality of deactivators is provided, such that each of at least two of the first, second and third walls carries a deactivator. The walls are oriented and dimensioned such that the object can be placed in the receptacle with the marker lying adjacent the wall carrying the deactivator so that the deactivator deactivates the marker, and such that the top and the bottom of the object cannot be placed in the receptacle opposite the first, second or third walls. The second receptacle is provided with an entry restricting mechanism for preventing an article from being inserted into the receptacle if the article has a height less than a specified minimum height.

47 Claims, 6 Drawing Sheets

DEACTIVATOR FOR THEFT-DETERRENT MARKERS

BACKGROUND

1. Field of the Invention

The present invention relates generally to the field of merchandise theft deterrent systems. More specifically, it relates to a deactivator for deactivating markers on products of various sizes, particularly compact disk and cassette cases.

2. Background of the Art

Pilferage of merchandise is a common and well known problem in retailing environments. In order to reduce the losses caused by pilferage, various article surveillance systems have been devised in order to apprehend or discourage pilferers from removing merchandise from the premises. In typical article surveillance systems, markers are secured to goods. These markers are designed to interact with an electromagnetic or magnetic field placed at the exit of the premises. When the marker passes through the field or "interrogation zone," an alarm is generated. Some markers of this type can be removed from the merchandise at the point of sale, before leaving the premises. Other markers are affixed to the merchandise and remain on the merchandise after it has been purchased and removed from the premises. Such markers are usually deactivated at the point of sale, prior to the merchandise leaving the premises.

One type of deactivatable marker is in the form of an electronic circuit comprising inductance and capacitance elements which resonate at radio frequencies. Another type of marker—a magnetic marker—comprises a strip of soft magnetic material which interacts with a ferromagnetic element made of a hard magnetic material which can be magnetized or demagnetized. The soft magnetic strip resonates and generates harmonics in the presence of a magnetic field having a certain frequency. This allows the marker to be detected. The hard ferromagnetic element can be magnetized or demagnetized, thereby deactivating or activating the marker.

Yet another type of marker is the acousto-magnetic or magneto-mechanical marker. This type of marker comprises a strip of magnetostrictive material and a strip of magnetic material of high coercivity. The magnetostrictive material resonates mechanically in the presence of a magnetic field of a particular frequency. This resonance can be detected by a receiver sensitive to the magnetic field created by the mechanically resonating magnetostrictive material. The marker is ordinarily deactivated by modifying the magnetic bias of the strip of magnetic material.

It is an object of the present invention to provide a deactivator for use at a retail point of sale in order to deactivate a theft-deterrent marker attached to an item of merchandise. More specifically, the present invention provides a deactivator for deactivating magnetic markers or magneto-mechanical markers on objects of various sizes.

While the present invention is not necessarily restricted to the deactivation of magnetic markers, it does address specific issues presented by magnetic and magneto-mechanical marker deactivators of the prior art. Such a deactivator of the prior art may be in the form of a flat pad. In order to deactivate a marker, the merchandise to which the marker is attached is placed on the flat magnetic pad. Because access to the pad is unrestricted, it is possible for items to be placed on the pad inadvertently or in any orientation. It is therefore a further object of the present invention to provide a magnetic deactivator which provides control over the type of object which is subject to the deactivating magnetic field and the orientation of the object in the magnetic field.

SUMMARY OF THE INVENTION

The present invention is a device for deactivating a theft-deterrent marker carried on an object such as an audio cassette case, a compact disk jewel case or a video cassette box. The device has a receptacle for receiving the object, the receptacle comprising a first wall, a second wall and a base for supporting the first and second walls. The first and second walls are spaced apart such that the object can be placed between the first and second walls. A deactivator for deactivating the marker is located in the receptacle such that the marker is deactivated when the object is placed between the first and second walls. Preferably, the first wall is moveable relative to the second wall and the second wall is fixed relative to the base.

A second aspect of the invention is a device for deactivating a marker secured to a specified object such as a cassette tape box having a length "l". The object has at least one side having a width "w" and a height "h" and at least one end having a length "l" and a height "h". "h" is less than "l" and is less than "w". The device comprises a housing which has a receptacle for receiving the specified object. The receptacle has an opening having a width approximately equal to "h" and such that the specified object can be placed in the receptacle side-first or end first. A deactivator is located in the receptacle such that, when the specified object is inserted into the receptacle, the deactivator deactivates the marker. The receptacle is provided with an entry restricting mechanism for preventing the insertion of an article having a height less than the permitted height "h".

Yet another aspect of the invention is a device for deactivating a marker on an object such as an audio cassette tape box having a top and a bottom, first and second sides and first and second ends, the marker being carried by one of the sides or one of the ends. The device comprises a housing having a receptacle comprising first, second and third walls arranged so as to form three sides of a box. A plurality of deactivators is provided, such that each of at least two of the first, second and third walls carries a deactivator. The walls are oriented and dimensioned such that the object can be placed in the receptacle with the marker lying adjacent the wall carrying the deactivator so that the deactivator deactivates the marker, and such that the top and the bottom of the object cannot be placed in the receptacle opposite the first, second or third walls.

DETAILED DESCRIPTION

The following is a description of the preferred embodiment of the invention. It is intended to be illustrative of the invention rather than limiting. The full scope of the invention is to be determined by the appended claims and their equivalents.

Figure 1:
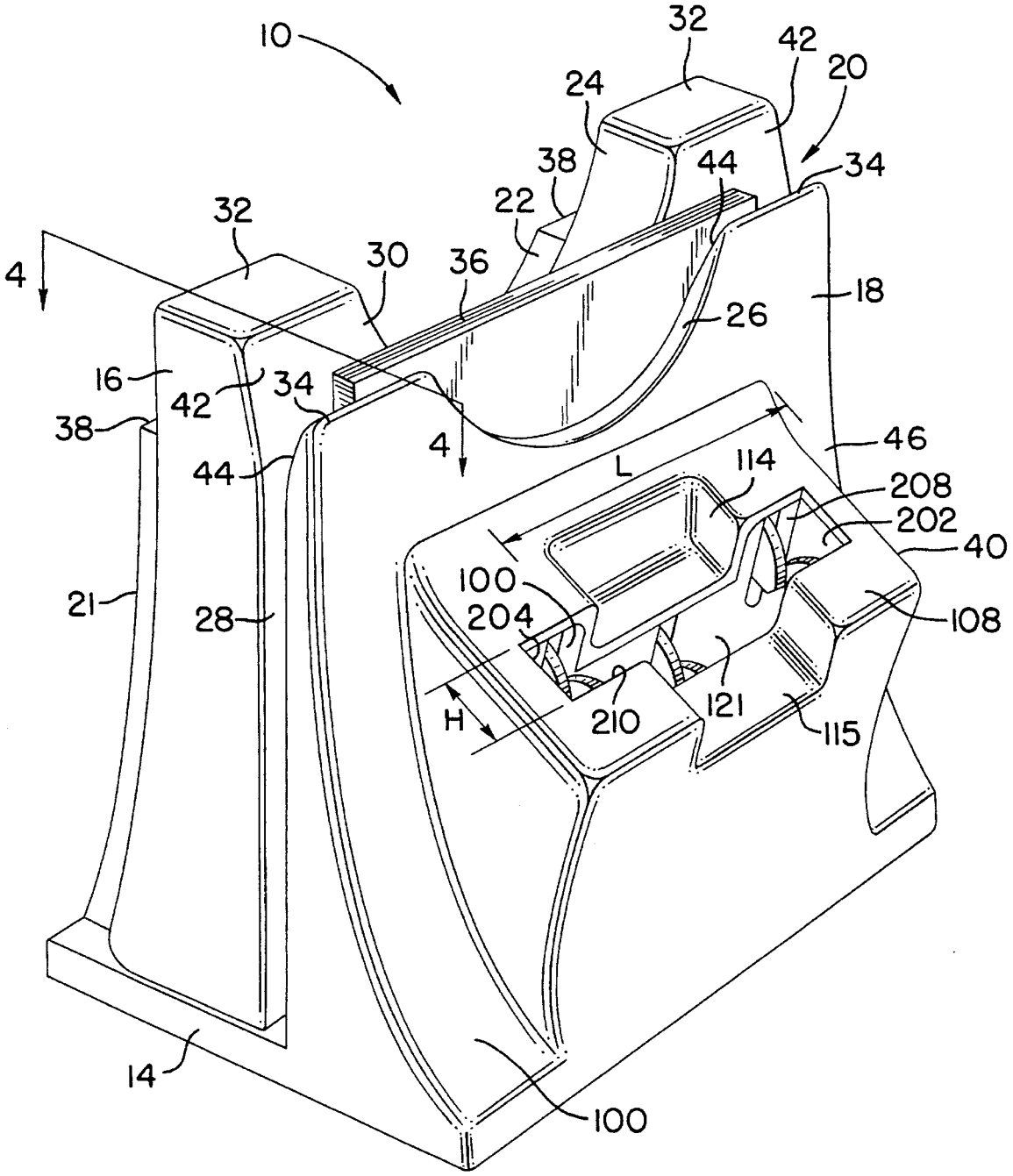
FIG. 1 is a perspective view of the deactivator assembly of the invention.

Deactivator assembly 10, shown in perspective view in FIG. 1, is designed to deactivate theft-deterrent markers on items of merchandise of two basic sizes (standard audio cassette cases and other larger boxes such as video cassette cases and compact disk cases). The preferred embodiment of the invention includes deactivating magnets for deactivating magneto-mechanical markers. However, by replacing the deactivating magnets with appropriate hardware known in the art, deactivator assembly 10 can also be used to deactivate other markers such as radio frequency markers or magnetic markers.

Figure 2:
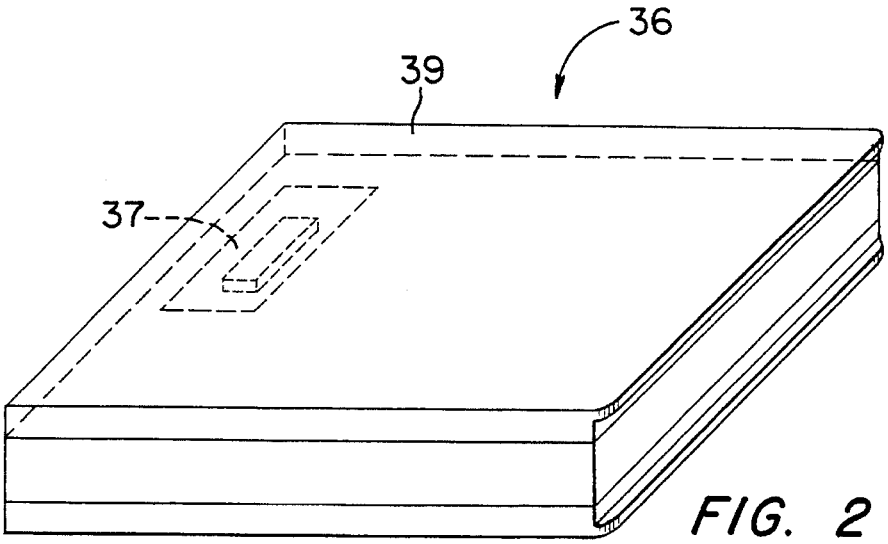
FIG. 2 is a perspective view of a compact disk case for holding two compact discs, and carrying a theft-deterrent marker.

Deactivator assembly 10 has a housing 20 having two receptacles, first receptacle 30 and second receptacle 40, into which items of different sizes can be inserted for deactivation. Housing 20 is preferably injection molded from a non-magnetic material such as polystyrene, polycarbonate or ABS but can be molded by other techniques such as blow molding. First receptacle 30 is designed and dimensioned so that it will accommodate and deactivate a magnetic marker on a conventional compact disk box, known as a "jewel case" (see FIG. 2) or a conventional video cassette case. In this description the term "first object 36" is intended to include jewel cases of various sizes as well as video cassette cases of a type shown in FIG. 2. As shown in FIG. 2, theft-deterrent marker 37 is preferably placed on the inside of wall 39 of jewel case 36. Marker 37 is preferably a magneto-mechanical marker of the type described in U.S. Pat. No. 4,510,489 which is incorporated herein by reference. Markers of this type are available from Sensormatic Electronics Corp. of Deerfield Beach, Fla. under the name Ultra*Max®. However, the invention can be used to deactivate other markers used in known electronic article surveillance systems.

Jewel cases come in different thicknesses depending on the number of compact discs they hold. First receptacle 30 is therefore adjustable so that it can accommodate substantially all commercially available jewel cases as well as video cassette cases.

Figure 3A:
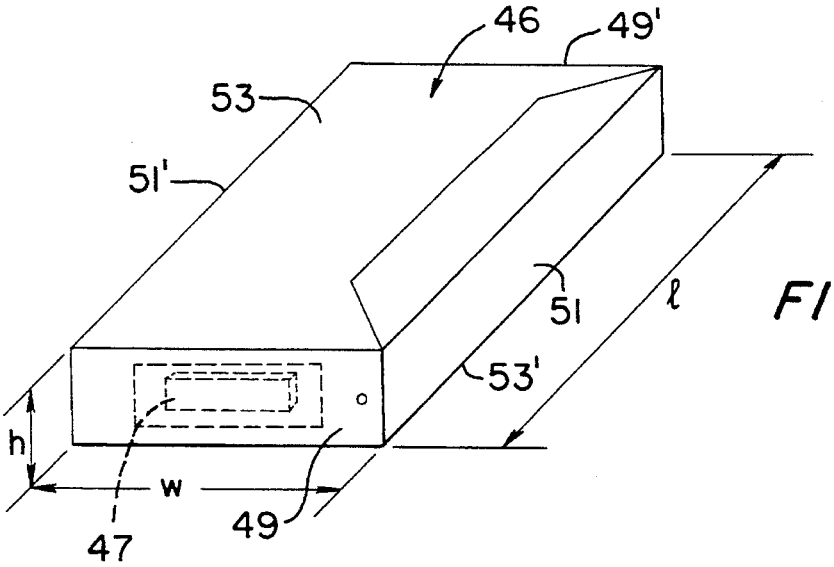
FIGS. 3*a* and 3*b* are perspective views of a standard audio cassette tape boxes carrying theft-deterrent markers.
Figure 3B:
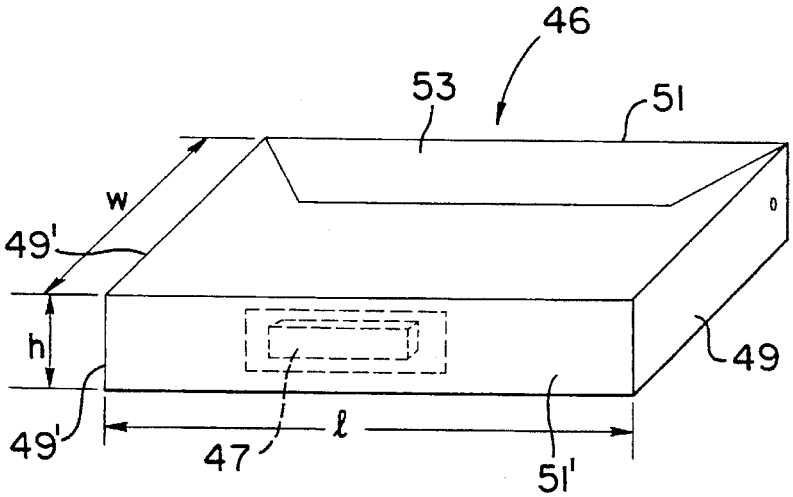

Second receptacle 40 is specifically designed and dimensioned so that it will allow a standard audio cassette case commonly known as a "Norelco box" (see FIGS. 3*a* and b) to be inserted side first. In addition, it is specifically designed to prevent the insertion of smaller cassette cases known as "Cassette Singles" or "O-boxes". An O-box is simply a standard audio cassette wrapped in a generally rectangular cardboard tube. Its length, width and height are slightly less than those of a Norelco box. The term "second object 46" is intended to encompass a standard audio cassette box with theft-deterrent marker 47 attached to it as shown in FIG. 3*a* and FIG. 3*b*.

First receptacle 30 is made up of base 14, first wall 16, second wall 18 and support 21. First wall 16 lies between support 21 and second wall 18 with a space 28 being formed between first and second walls 16 and 18. First wall 16 is slidable between support 21 and second wall 18. Space 28 is dimensioned so that first object 36 can be placed between first and second walls 16 and 18 in a manner described below. First and second walls 16 and 18 are respectively provided with arcuate cutouts 24 and 26. Support 21 is also provided with arcuate cutout 22. The arcuate cutouts facilitate the placement of object 36 into, and its removal from, first receptacle 30 by allowing an operator easily to grasp first object 36 and thus insert it into, or withdraw it from, space 28. First and second walls 16 and 18 respectively have narrow upper regions 32 and 34. Likewise, support 21 has narrow upper regions 38. Upper regions 32 and 34 are respectively provided with vertically tapered inner surfaces 42 and 44 facing space 28 which act as guides to guide first object 36 into space 28. Upper regions 32 and 34 taper from a first width proximal of base 14 to a narrower width distal of base 14.

Figure 5:
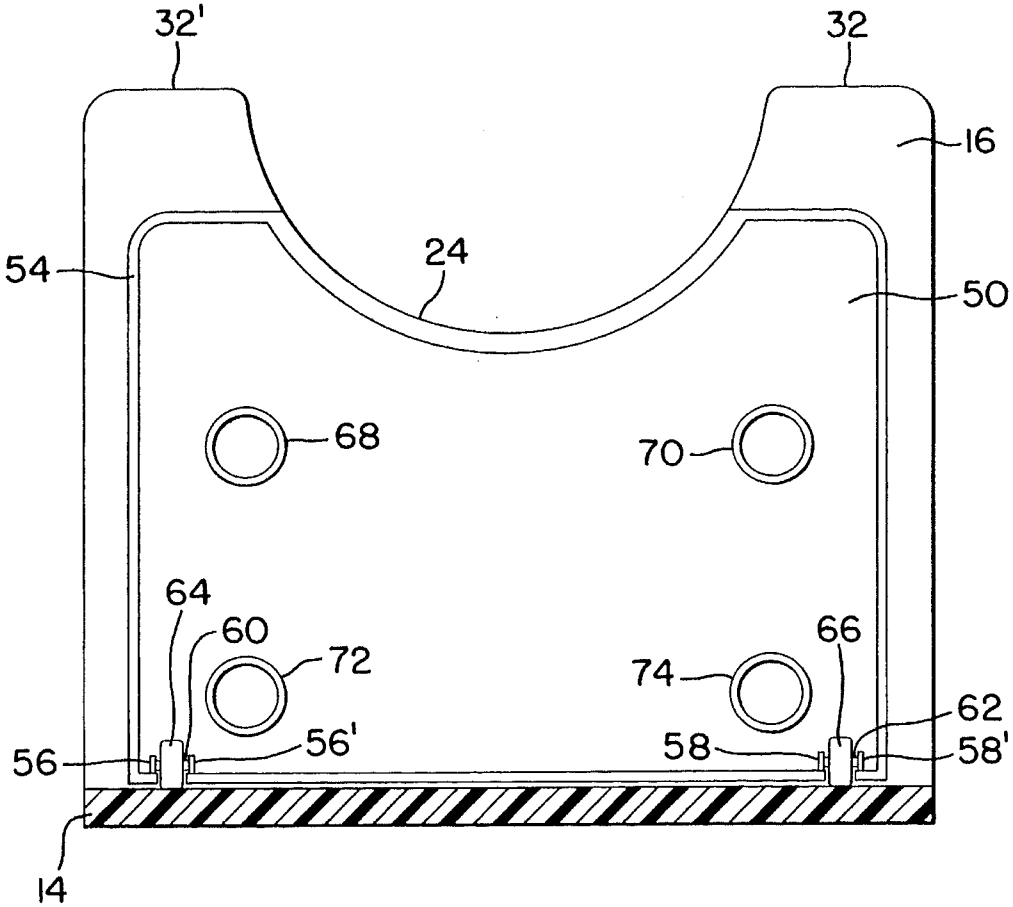
FIG. 5 is a cross-sectional rear view of the deactivator assembly taken through section 5—5 of FIG. 4.

First wall 16 is slidable between support 21 and second wall 18 in a direction perpendicular to second wall 18. This allows objects of different thicknesses (e.g. a jewel case or a video cassette) to be placed in space 28 so that their markers can be deactivated. The specific structure for accomplishing this is shown in FIGS. 4 and 5.

Figure 4:
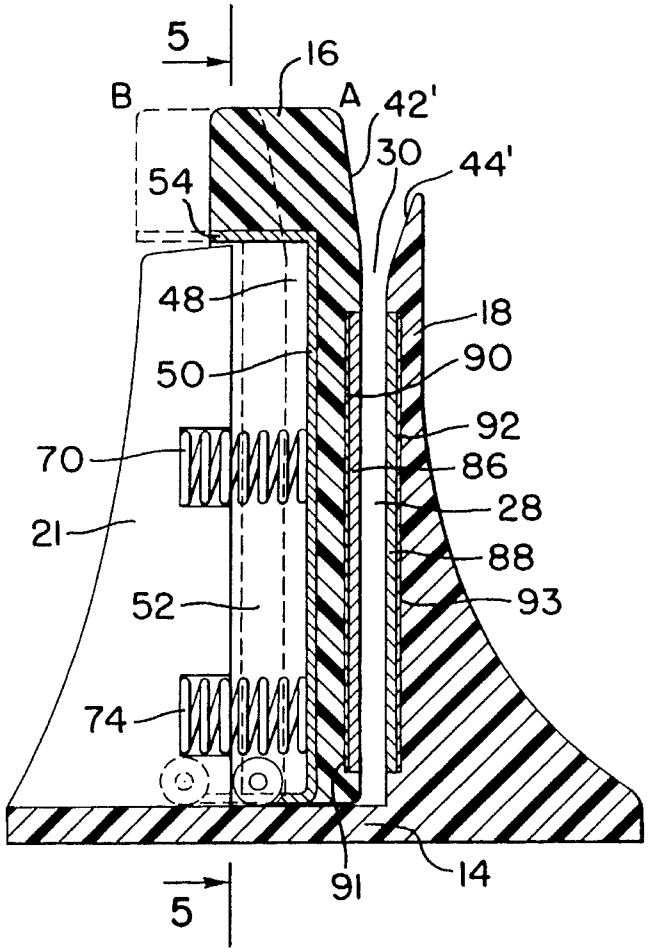
FIG. 4 is a cross-sectional side view of the deactivator assembly taken through 4—4 of FIG. 1.

FIG. 4 is a cross-sectional view though section 4—4 of FIG. 1. First wall 16 is provided with a first recess 48 which accommodates chassis 50. Chassis 50 is stamped sheet metal member which is placed in recess 48 of first wall 16. Chassis 50 is provided with rim 54 (see FIG. 5) and thus defines a cavity 52 which mates with support 21 as shown in FIG. 4 in order to locate first wall 16.

First wall 16 is slidable with respect to support 21 between a first position "A" shown in FIG. 4 in solid lines and a second position "B" shown in FIG. 4 in dashed lines. Chassis 50 is provided with flanges 56 and 58 adjacent base 14 (see FIG. 5). Flanges 56 and 58 respectively carry axles 60 and 62 which in turn carry rollers 64 and 66. Rollers 64 and 66 run along base 14 and allow first wall 16 to move smoothly along base 14 between first position "A" and second position "B". Support 21 provides a guide for first wall 16 as it slides between positions "A" and "B".

Four helical compression springs 68, 70, 72 and 74 are provided to bias first wall 16 into position "A" relative to support 21, such that when the springs are relaxed at equilibrium, space 28 is at its narrowest. Springs 68, 70, 72 and 74 are secured at their first ends to chassis 50. At their second ends springs 68, 70, 72 and 74 are secured to recesses in support 21. First wall 16 can be urged against the bias of the springs into position "B", for example to place first object 36 between first wall 16 and second wall 18 or remove first object 36. In its equilibrium state, first wall lies in position "A" due to the bias of the springs. The structure just described permits the accommodation of jewel cases of various sizes as well as video cassette cases in first receptacle 30.

Figure 6:
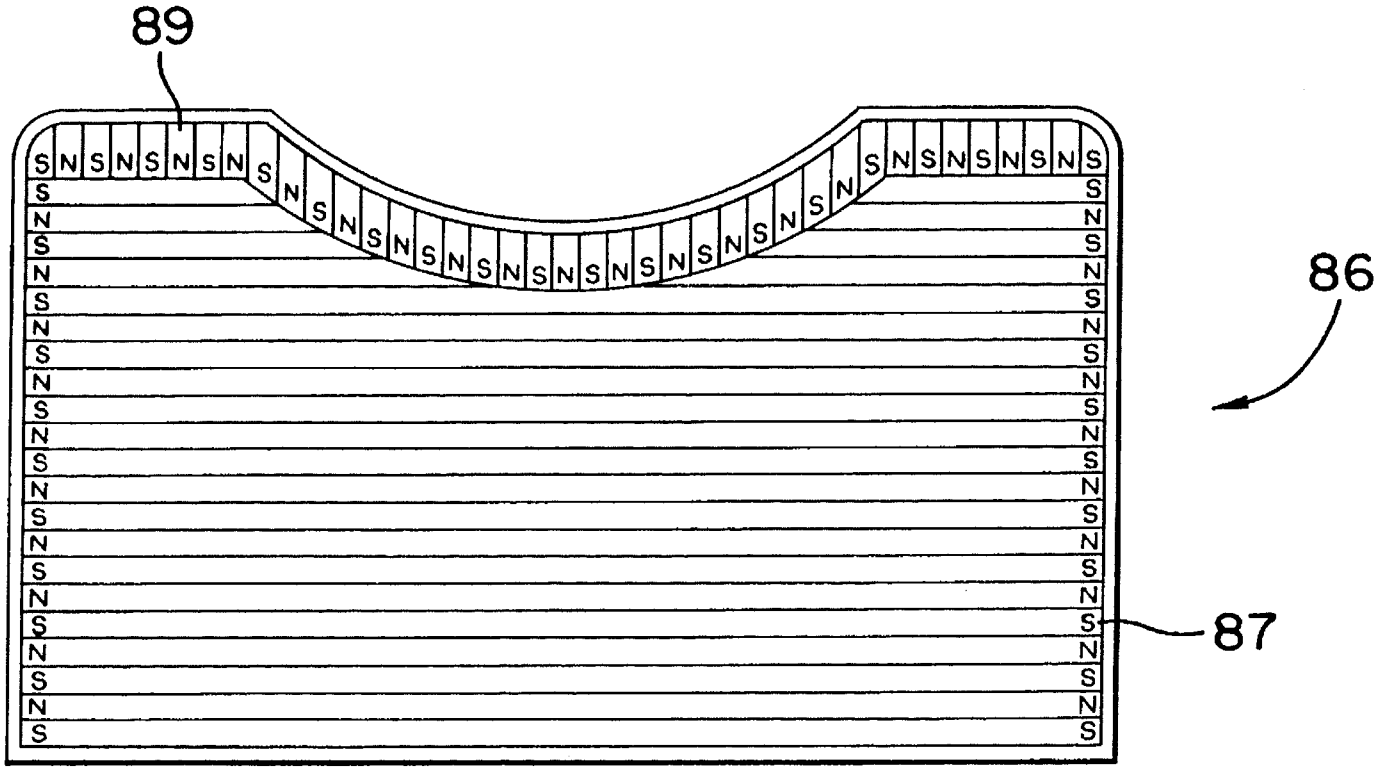
FIG. 6 is a front view of the deactivator magnet for the first receptacle of the deactivator assembly.

First and second walls 16 and 18 respectively carry permanent magnets 86 and 88 which are designed to deactivate the marker carried by first object 36. To this end, first and second walls 16 and 18 are respectively provided with recesses 90 and 92 which accommodate magnets 86 and 88 respectively. Magnets 86 and 88 are secured to steel keeper plates 91 and 93 (to enhance the magnetic field) and placed in recesses 90 and 92 by a pressure sensitive adhesive. (See FIG. 4.) Magnets 86 and 88 are substantially identical and have arcuate cutouts shaped substantially identically to those of walls 16 and 18. The general structure of magnets 86 and 88 is shown in FIG. 6. Since magnets 86 and 88 are substantially identical, only one magnet, magnet 86 will be described with the understanding that the description applies equally to magnet 88.

Magnet 86 is a flexible magnet made of a flat sheet of extruded rubberized magnetic material having a thickness of approximately 0.065". The magnetic material 86 is made up of a series of magnets 87, each of which has a north pole and a south pole oriented oppositely to those of its neighbors. Magnet 86 is further made up of the same magnetic material oriented such that a series of magnets 89 is arranged along the arc of arcuate cutout 21, substantially perpendicular to magnets 87. The following specifications are preferred for magnet 86: coercive force: 1900 Oe, reference; residual induction: 2200 Gauss reference; maximum energy product: 1.4 MGOe, minimum, reference; absolute value surface field: 500–600 Gauss. The magnetic pole spacing of magnets 87 and 89 is 4 poles per inch magnetized along the length of the roll and magnetized on both sides. These specifications are preferred for the deactivation of the Ultra*Max® magneto-mechanical marker available from Sensormatic Electronics Corp. of Deerfield Beach, Fla. Magnet 86 is a permanent magnet. An electromagnet may also be used.

Due to the alternating pole structure and strength of magnets 86 and 88, the magnetic field produced by magnets 86 and 88 extends only a short distance into space 28. The magnetic field produced by magnets 86 and 88 is negligible beyond about 3 mm from the respective surfaces of magnets 86 and 88. This distance is sufficient to deactivate the marker without affecting the integrity of the information on any magnetic tape (e.g. video tape) in first object 36.

First receptacle 30 is used to deactivate magnetic markers, typically at a point of retail sale. It is used in the following manner: First wall 16 is initially in first position "A"—its equilibrium state (See FIG. 4). First object 36 carrying marker 37 is simply placed between first and second walls 16 and 18 in space 28 such that marker 37 abuts first or second walls 16 or 18. The placement of the first object between walls 16 and 18 is facilitated by tapered portions 42 and 44 which guide the object into space 28. The placement of first object 36 forces first wall 16 against the bias of springs 68, 70, 72 and 74, thus causing first wall to slide away from second wall 18 and into second position "B" sufficient to allow space 28 to receive object 36. First object 36 is left in space 28 for a moment and then removed. The bias of springs 68, 70, 72 and 74 causes first wall to return to rest in position "A" on removal of first object 36 from space 28. When first object 36 lies between first and second walls 16 and 18, magnet 86 or 88 deactivates marker 37 in a known manner depending on which direction the marker faces.

Second receptacle 40 will now be described. Front surface 100 of second wall 18 has a generally arcuate profile as shown in FIG. 1. Extending outwardly from front surface 100 is second receptacle 40 having a box-like structure protruding from front surface 100. Within this box-like structure is a slot 110 dimensioned to receive second object 46 so that marker 47 on second object 46 can be deactivated. Receptacle 40 thus accommodates deactivating magnets which will be described below. Top wall 108 is provided with recesses 114 and 115 which facilitate the grasping of second object 46 by an operator, to allow the placement into and removal from receptacle 40 of second object 46.

Second receptacle 40 is designed to allow deactivation of markers on cassette boxes of specific sizes (Norelco boxes) and to prevent insertion of boxes of other sizes (O-boxes). The type of cassette box for which second receptacle 40 is intended to be used is the audio cassette box 46 shown in FIGS. 3*a* and 3*b*. Box 46 is generally rectangular. It has first and second ends 49 and 49' and first and second sides 51 and 51'. First and second ends 49, 49' have a specified width "w" and a specified height "h". First and second sides 51, 51' have a specified length "l" and a specified height "h". Top and bottom sides 53, 53' have a length "l" and a width "w". Height "h" is less than width "w", which is less than length "l". Magnetic marker 47 is shown secured to the inside surface of end 49 in FIG. 3*a* and to the inside surface of side 51 in FIG. 3*b*.

In order to prevent cassette cases larger than the Norelco box from being inserted into receptacle 40, slot 110 is dimensioned so that its length "L" and width "H" are respectively substantially equal to the length "l" and height "h" of the Norelco box 46 shown in FIGS. 3*a* and 3*b*. Consequently, a Norelco box can be inserted into receptacle 40 end first or side first but not top or bottom first.

In order to prevent the insertion of objects smaller than a Norelco box such as O-boxes, receptacle 40 is provided with an entry restricting mechanism 121 which prevents entry of objects smaller than a Norelco box. See FIGS. 7–12.

Receptacle 40 is provided with a liner 120 which serves as a chassis to support the entry restricting mechanism. Liner 120 also provides the inner walls of receptacle 40. Specifically, liner 120 is made up of first and second walls 202 and 204. First and second walls 202 and 204 lie opposite each other and are generally parallel to one another. Third wall 206, which is generally perpendicular to first and second walls 202 and 204, lies deep within receptacle 40 and connects the bases of first and second walls 202 and 204. Fourth and fifth walls 208 and 210 also connect first and second walls 202 and 204 and lie parallel to each other and perpendicular to third wall 206. First, second and third walls 202, 204 and 206 form three sides of a rectangular open-ended box, with slot 110 at its open end. Fourth and fifth walls 208 and 210 form fourth and fifth walls of the box. First second and third walls 202, 204 and 206 have width "H" which corresponds to height "h" of box 46. Fourth and fifth walls 208, 210 have a length "L" which corresponds to length "l" of box 46. The length "B" of first, second, fourth and fifth walls 202, 204, 206, 208 and 210 and hence the depth of receptacle 40 is slightly less than width "w" of box 46 so that when a Norelco box 46 is inserted into receptacle 40, part of box 46 protrudes from receptacle 40. From the above description it can be seen that the dimensions of receptacle 40 are such that box 46 can be inserted into receptacle 40 end first or side first but not top or bottom first.

Figure 7:
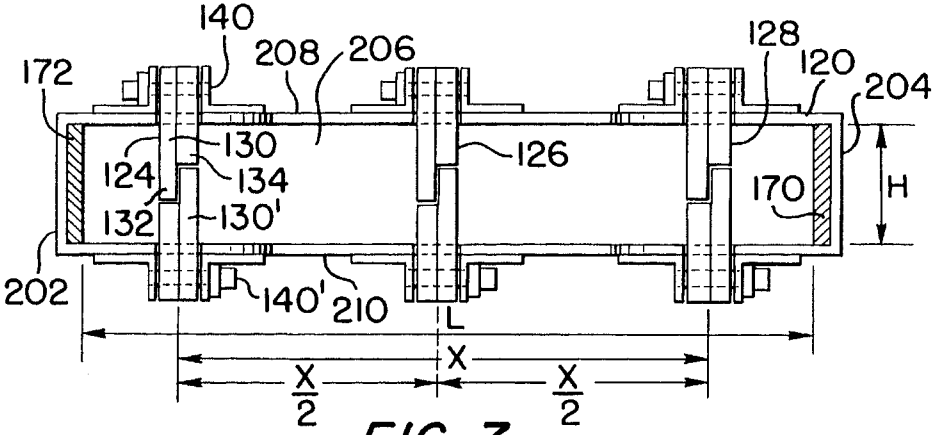
FIG. 7 is a top view of the slot of the first embodiment of the second receptacle of the invention.
Figure 8:
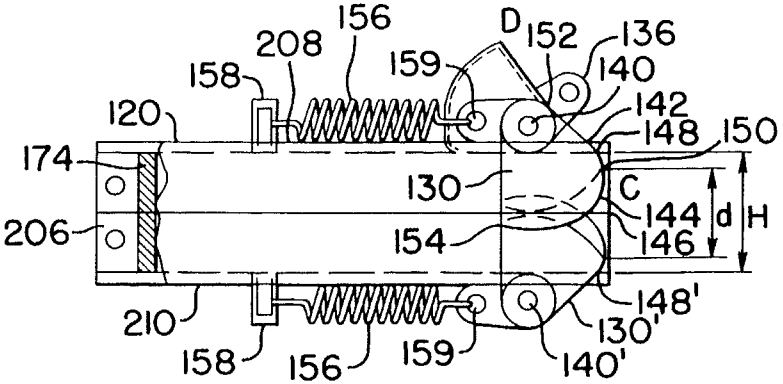
FIG. 8 is a side view of the slot of the first embodiment second receptacle of the invention.

Deactivators are placed within receptacle 40 as follows: First and second deactivators 170 and 172 are placed along the length of first and second walls 202 and 204 respectively as shown in FIG. 7. Thus, when box 46 is inserted into receptacle 40 with walls 49, 49' aligned with and in close proximity to first and second walls 202, 204, a marker 47 secured to either of walls 49, 49' will be deactivated by deactivator 170 or 172. A further deactivator 174 is placed along the length of third wall 206 as shown in FIG. 8.

Deactivators 170, 172 and 174 are made of the same material as magnets 86 and 88. When box 46 is inserted into receptacle 40 as just described, a marker on wall 51 or 51' (depending on the orientation of box 46) will be deactivated by deactivator 174. If box 46 is inserted into receptacle 40 such that wall 49 or 49' comes into close proximity to third wall 206, a marker on wall 49 or 49' will be deactivated by deactivator 174. Thus, as long as box 46 is inserted into receptacle with a wall 49, 49' or 51, 51' facing first, second or third walls 202, 204 or 206, a marker on wall 49, 49' or 51, 51' will be deactivated. Since there are no deactivators on fourth and fifth walls 208 and 210, top and bottom 53, 53' of box 46 are not subject to any appreciable magnetic field when box 46 is inserted into receptacle 40. Due to the dimensions of receptacle 40, it is not possible to insert box 46 into receptacle 40 such that top and bottom 53, 53 are significantly subject to the magnetic fields generated by deactivators 170, 172 and 174.

Figure 9:
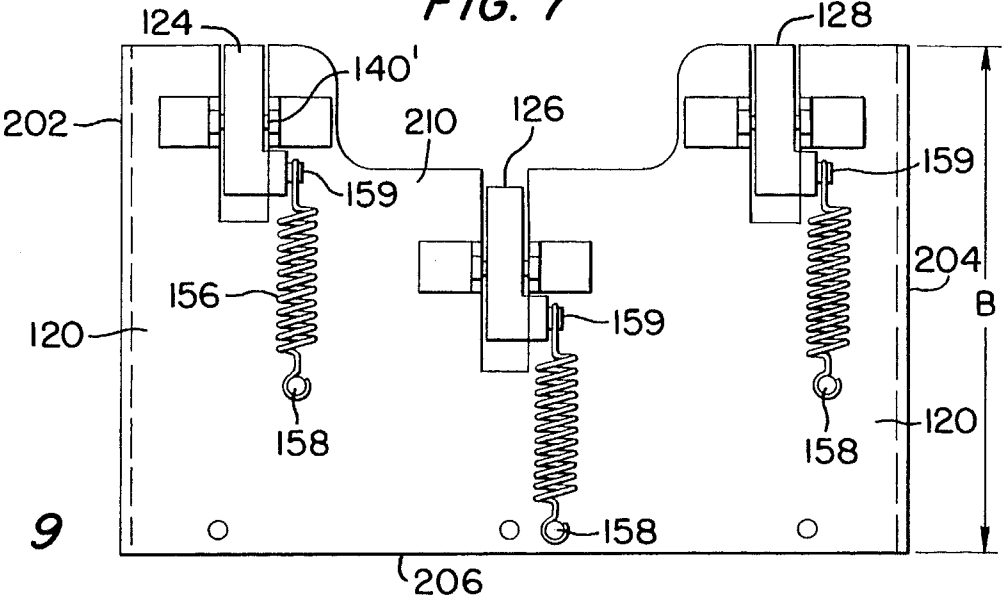
FIG. 9 is a front side view of the liner of the first embodiment of the second receptacle of the invention.

In the preferred embodiment, the entry restricting mechanism 121 is made up of three pairs of interlocking cam assemblies 124, 126 and 128. Cam assemblies 124 and 128 are placed at substantially the same depth within liner 120, whereas cam assembly 126 is placed slightly deeper within liner 120 as can be seen in FIG. 9. Each of the cam assemblies is substantially identical, so it is sufficient to describe only one cam assembly 124.

Each cam assembly is made up of two interlocking cams 130, 130'. Cams 130 and 130' are identical so only the apparatus associated with cam 130 will be described with the understanding that each element associated with cam 130' is identified in the drawings by a corresponding primed numeral. Each cam is pivoted on an axle 140. Each cam is biased by spring 156. Spring 156 is a helical spring secured at one end to liner 120 by means of post 158 and at the other end to cam 130 by means of screw 159. Cam 130 has a stepped structure as shown in FIGS. 7 and 8. A first part 132 of the stepped structure protrudes farther outward than a second part 134. This allows cams 130 to interlock as shown in FIGS. 7 and 8. Cam 130 is also provided with a stop 136 which prevents full rotation of cam 130 by abutting liner 120 when cam 130 is rotated to from position "C" to position "D" as shown in FIG. 8.

When viewed from the side as shown in FIG. 8, cam 130 has an arcuate profile. The arcuate profile of cam 130 is made up of two surfaces. First surface 142 extends from point 150 to point 152 and slopes in a direction away from center line 146 of slot 110. Second surface 144 slopes towards center line 146, extending from point 150 to point 154. First surface 142 of each cam therefore faces away from the other cam in the pair and second surface 144 faces towards the other cam.

Cams 130 are dimensioned such that when a Norelco box is inserted into opening 112, side 51 or 51' or end 49 or 49' abuts first surfaces 142 at points 148 which are approximately a distance "d" apart. This corresponds approximately to the height "h" of the Norelco box described above. Further insertion of the box into receptacle 40 causes cams 130 to rotate about pivots 140 against the bias of springs 156. If an object such as an O-box having a width smaller than "h" is inserted into slot 110, it will abut surfaces 144 of cams 130. The attempted insertion of such an object into receptacle 40 causes the object to be wedged between cams 130. Due to the direction in which surfaces 144 slope (towards the center line), surfaces 144 direct components of the insertion force towards each other. These components are transmitted through the object to the opposite cam, thus wedging the object between the cams. If the object is inserted into receptacle 40 such that it abuts surface 142 of cam 130 and surface 144 of the other cam, the abutment with surface 144 will still cause the object to be wedged between the cams because a component of the insertion force is directed towards the opposite cam.

Cam assemblies 124 and 128 are spaced apart a distance "X" slightly less than length "l" of a Norelco box and slightly more than width "w" of the Norelco box. A Norelco box can thus be inserted side first or end first between cam assemblies 124 and 128 .

Cam assembly 126 is equally spaced between cam assemblies 124 and 128 by a distance "X/2". Thus, whether the O-box is inserted side first or end first into slot 110, it will be blocked by at least two of cam assemblies 124, 126 or 128. Nevertheless, a Norelco box can be inserted into receptacle 40 side first or end first because either way it will not be blocked by cam assembly 124, 126 or 128.

Figure 10:
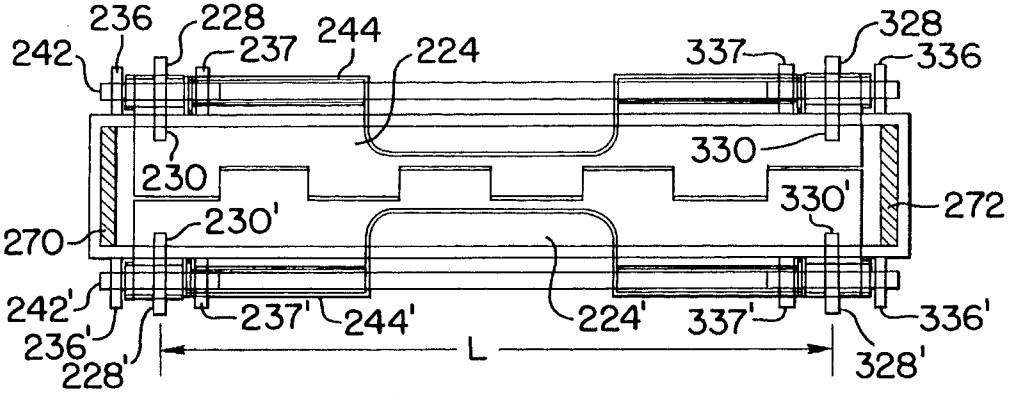
FIG. 10 is a top view of the slot of the second embodiment of slot of the second receptacle of the invention.
Figure 12:
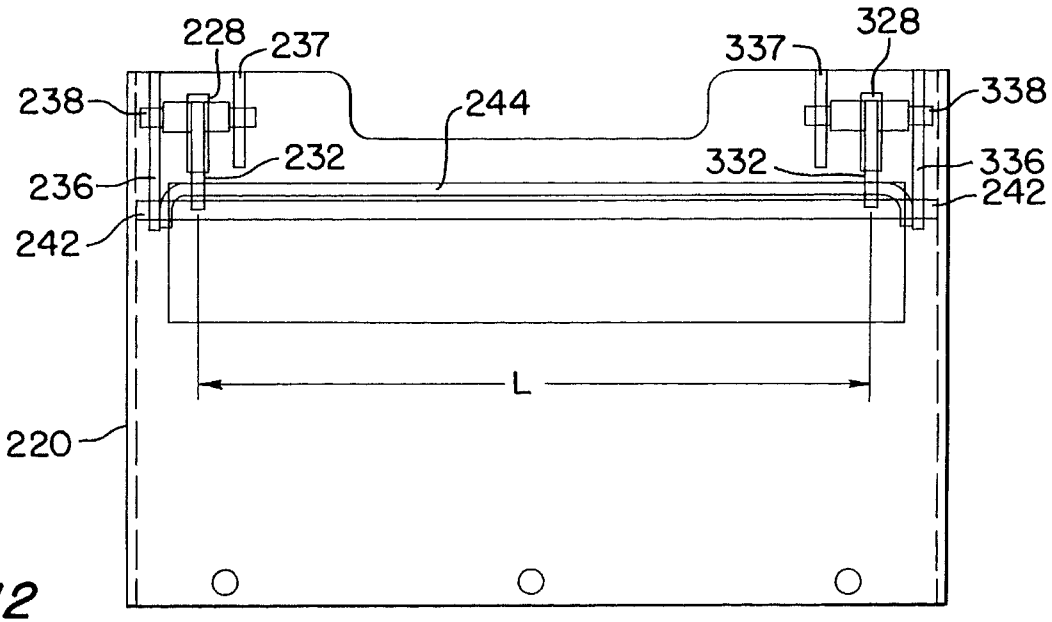
FIG. 12 is a front side view of liner of the second embodiment of the second receptacle of the invention.
Figure 11:
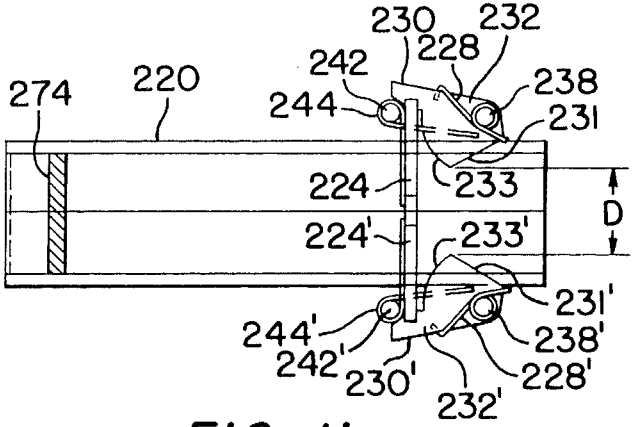
FIG. 11 is a side view of the slot of the second embodiment of the second receptacle of the invention.

An alternative embodiment of the entry restriction device for receptacle 40 is shown in FIGS. 10, 11 and 12. Liner 220 is placed in receptacle 40. Liner 220 is identical to liner 120, except for a door structure which replaces the cam mechanism of liner 120. Access to receptacle 40 is restricted by doors 224 and 224' instead of the three pairs of cams. Both doors are substantially identical, so only one door 224 will be described.

Door 224 is recessed within receptacle 40 by a distance of approximately 0.75'. Door 224 is hinged to axle 242 which extends substantially along the length of slot 110. Axle 242 is carried by flanges 236 and 336 which are secured to liner 220. Flanges 236 and 336 (with flanges 237 and 337) also act as bearings for axles 238 and 338 which carry actuators 232 and 332.

The opening of door 224 is controlled by actuators 232 and 332 which are designed to allow door 224 to open only when a correctly dimensioned object (a Norelco box) is inserted into receptacle 40. Actuators 232 and 332 and their associated assemblies are identical, so only actuator 232 will be described in detail. Actuator 232 is provided with a generally flat front face 231, a curved rear surface 233 and a stop 230. Actuator 232 is biased by spring 228. Door 224 is biased by spring 244. Spring 244 keeps door 224 closed. In the rest position shown in FIG. 11, stop 230 abuts an outer side of door 224 thus preventing door 224 from opening. The bias of spring 228 keeps actuator 232 in an equilibrium position with door 224 closed. As long as actuator 232 is in its equilibrium position, door 224 cannot open.

When a correctly dimensioned object is inserted into receptacle 40, it abuts front face 231 of actuator 232. Further insertion of the object causes actuator 232 to rotate against the bias of spring 228 so that stop 230 no longer abuts door 224. Door 224 can thus open. Further insertion of the object opens door 224 by pushing against the bias of spring 228.

As can be seen in FIGS. 10 and 11, doors 224 close receptacle 40. Each door extends approximately half way across slot 110. Doors 224 are designed to interlock, being provided with stepped inner surfaces as shown in FIG. 10. Doors 224 and actuators 232 and 332 are oriented such that the insertion of certain objects smaller than a Norelco box, is prevented. Specifically, actuators 232 and 332 are spaced apart a distance "D" approximately equal to the height "h" of a Norelco box as shown in FIGS. 3*a* and 3*b*. Thus the insertion of a Norelco box into receptacle 40 will cause actuators 232 and 232' to rotate and open doors 224. Any object having a height less than that of the Norelco box will not abut both of actuators 232 and 232' and will thus only be able to open one of doors 224. In addition, actuators 232 and 332 are disposed along the length of slot 110 separated by a distance "L" slightly less than the length "l" of a Norelco box. Thus, any object having a length slightly less than the length of a Norelco box will only be able to abut one set of actuators 232 or 332 and will not be able to open doors 224.

In order to deactivate marker 47 on object 46, receptacle 40 of the second embodiment is provided with a plurality of magnets 270, 272 and 274. Magnets 270, 272 and 274 are identical to magnets 170, 172 and 174 as is their positioning in receptacle 40. Marker 47 is thus deactivated in the same way using magnets 270, 272 and 274 as magnets 170, 172 and 174.

We claim:

1. A device for activating a theft deterrent marker on an object, the device comprising:

a receptacle for receiving the object, the receptacle comprising a first wall and a second wall defining a space therebetween, the first and second walls being spaced apart such that the object can be placed in the space between the first and second walls and the first wall being movable relative to the second wall such that the size of the space between the walls varies according to the size of the object;

a deactivator for deactivating the marker, the deactivator being positioned in the receptacle such that the marker is deactivated when the object is placed between the first and second walls; and means for biasing the first wall towards the second wall such that when the object is placed in the space between the first and second walls, the object is held between the first and second walls by the means for biasing.

2. The device of claim 1 wherein the means for biasing comprises a spring.

3. The device of claim 2 wherein the first wall is slidable relative to the second wall.

4. The device of claim 2 wherein at least part of the deactivator is located in the first wall.

5. The device of claim 2 wherein at least part of the deactivator is located in the second wall.

6. The device of claim 2 further comprising a support for supporting the first wall such that the first wall lies between the second wall and the support.

7. The device of claim 2 wherein the first wall is provided with a cutout to facilitate placement of the object between the first and second walls.

8. The device of claim 2 wherein the second wall is provided with a cutout to facilitate placement of the object between the first and second walls.

9. The device of claim 2 wherein the deactivator is a magnetic deactivator.

10. The device of claim 2 wherein the deactivator comprises a permanent magnet.

11. The device of claim 10 wherein the permanent magnet comprises a plurality of alternating north and south poles.

12. The device of claim 2 wherein the deactivator comprises a first magnet secured to the first wall and a second magnet secured to the second wall.

13. A device for deactivating a marker secured to a specified object having a length "l", a width "w" and a height "h", and comprising at least one side having a width "w" and a height "h" and at least one end having a length "l" and a height "h", and wherein "h" is less than "l" and is less than "w" the device comprising:

a housing;

a receptacle in the housing, the receptacle having an opening having a width approximately equal to "h" and such that the specified object can be placed in the receptacle side first or end first;

a deactivator located in the receptacle such that, when the specified object is inserted into the receptacle, the deactivator deactivates the marker;

an entry restricting mechanism for preventing an article from being inserted into the receptacle if the article has a height less than "h".

14. The device of claim 13 wherein the entry restricting mechanism comprises means for preventing an article from being inserted into the receptacle if the article has a length less than "l".

15. The device of claim 13 wherein the entry restricting mechanism comprises a cam assembly.

16. The device of claim 13 wherein the cam assembly comprises a first pair of cams.

17. The device of claim 16 wherein the cams interlock.

18. The device of claim 16 wherein the cams are shaped to wedge the article between the cams if the article has a height less than "h".

19. The device of claim 16 comprising a second pair of cams spaced from the first pair of cams a distance less than "l".

20. The device of claim 16 wherein each of the cams comprises a first and a second surface, the first surface of each cam facing the first surface of the other cam and the cams being spaced from each other such that when an article having a height less than "h" is inserted into the receptacle such that the article abuts the first surface of one of the cams, the article is wedged between the cams and the cams cannot rotate, thus preventing the object from entering the receptacle.

21. The device of claim 20 wherein the second surface of each cam faces away from the second surface of the other cam, the second surfaces of the cams being spaced such that when the specified object is inserted into the receptacle such that it abuts the second surfaces of the cams, the cams rotate, thereby allowing the specified object to enter the receptacle.

22. The device of claim 19 further comprising means for biasing the cams so that when they are in their equilibrium state, they close off the receptacle.

23. The device of claim 19 further comprising a third pair of cams located between the first and second pair of cams.

24. The device of claim 23 wherein the third pair of cams is located at approximately an equal distance from each of the first and second pair of cams.

25. The device of claim 13 wherein the means for preventing the article from being inserted into the receptacle comprises a pair of doors.

26. The device of claim 25 further comprising an actuator for opening each door, the actuator being actuated by insertion of the article if it has a height approximately equal to "h" but not by an article having a height less "h".

27. The device of claim 25 further comprising means for biasing the doors so that the doors tend to close the receptacle.

28. The device of claim 27 wherein the means for biasing comprises a spring.

29. The device of claim 26 further comprising a second actuator for opening each door, the actuator being actuated by insertion of an article having a length approximately equal to "l", but not by an article having a length less than "l".

30. The device of claim 13 wherein the deactivator is an magnetic deactivator.

31. A device for deactivating a marker on an object, the object having a top and a bottom, first and second sides and first and second ends, the marker being carried by one of the sides or one of the ends, the device comprising:

a receptacle comprising first, second and third walls arranged so as to form three sides of a box;

a plurality of deactivators, such that each of at least two of the first, second and third walls carries a deactivator, wherein the walls are oriented and dimensioned such that the object can be placed in the receptacle with the marker lying adjacent the wall carrying the deactivator so that the deactivator deactivates the marker, and such that the top and the bottom of the object cannot be placed in the receptacle opposite the first, second or third walls.

32. The device of claim 31 wherein the first and second walls are parallel to each other and the third wall is perpendicular to the first and second walls.

33. The device of claim 32 further comprising a fourth wall perpendicular to the first, second and third walls such that the first, second, third and fourth walls form four sides of an open-ended box.

34. The device of claim 31 wherein the deactivator is carried by the first wall.

35. The device of claim 31 wherein the deactivator is carried by the second wall.

36. The device of claim 31 wherein the deactivator is carried by the third wall.

37. The device of claim 31 wherein the first and second ends and the first and second sides of the object have a height "h" and the top and bottom have a width "w" and a length "l" and such that "h" is less than "w" and is less than "l".

38. The device of claim 37 wherein the first, second and third walls of the receptacle have a width approximately equal to "h".

39. The device of claim 37 wherein the receptacle is provided with an opening dimensioned such that the object can be inserted into the opening side wall first or end wall first but not top or bottom first.

40. The device of claim 31 comprising first, second and third deactivators respectively carried by the first, second and third walls of the receptacle such that the marker can be deactivated by one of the deactivators when the object is placed in the receptacle irrespective of whether the marker is carried on the first or second end or the first or second side.

41. The device of claim 31 further comprising means for preventing placement in the receptacle of an object having a height less than approximately "l", "w" or "h".

42. The device of claim 41 wherein the means for preventing comprises a cam assembly.

43. The device of claim 41 wherein the means for preventing comprises a door assembly.

44. A device for deactivating a theft deterrent marker on an object, the device comprising:

a receptacle for receiving the object, the receptacle comprising a first wall and a second wall defining a space therebetween, the first and second walls being spaced apart such that the object can be placed in the space between the first and second walls and the first wall being movable relative to the second wall such that the size of the space between the walls varies according to the size of the object;

a deactivator for deactivating the marker, the deactivator being positioned in the receptacle such that the marker is deactivated when the object is placed between the first and second walls, and at least a part of the deactivator being located in the first wall.

45. A device for deactivating a theft deterrent marker on an object, the device comprising:

a receptacle for receiving the object, the receptacle comprising a first wall and a second wall defining a space therebetween, the first and second walls being spaced apart such that the object can be placed in the space between the first and second walls and the first wall being movable relative to the second wall such that the size of the space between the walls varies according to the size of the object;

a deactivator for deactivating the marker, the deactivator being positioned in the receptacle such that the marker is deactivated when the object is placed between the first and second walls, and the deactivator comprising a permanent magnet.

46. The device of claim 45 wherein the permanent magnet comprises a plurality of alternating north and south poles.

47. A device for deactivating a theft deterrent marker on an object, the device comprising:

a receptacle for receiving the object, the receptacle comprising a first wall and a second wall defining a space therebetween, the first and second walls being spaced apart such that the object can be placed in the space between the first and second walls and the first wall being movable relative to the second wall such that the size of the space between the walls varies according to the size of the object;

a deactivator for deactivating the marker, the deactivator being positioned in the receptacle such that the marker is deactivated when the object is placed between the first and second walls, and the deactivator comprising a first magnet secured to the first wall and a second magnet secured to the second wall.

* * * * *